US005758440A

United States Patent [19]

Yudin

[11] Patent Number: 5,758,440

[45] Date of Patent: Jun. 2, 1998

[54] TRANSPARENT LIQUID PRODUCT DISPLAY METHOD AND CONTAINER

[76] Inventor: Cal Yudin, 1806 Marietta Blvd., NW., Atlanta, Ga. 30318

[21] Appl. No.: 89,512

[22] Filed: Jul. 21, 1993

[51] Int. Cl.[6] ..... G09F 3/00

[52] U.S. Cl. ..... 40/310; 283/81; 283/109

[58] Field of Search ..... 40/310, 406, 409; 215/1 R, 365, 366; 283/81, 109, 117

[56] References Cited

U.S. PATENT DOCUMENTS

| | | | |
|---|---|---|---|
| 635,098 | 10/1899 | Henckel | 40/310 |
| 2,158,633 | 5/1939 | Normandi . | |
| 2,305,890 | 12/1942 | Moore | 40/310 |
| 3,874,977 | 4/1975 | Pyles | 40/310 X |
| 4,115,939 | 9/1978 | Marks | 40/310 |
| 4,658,974 | 4/1987 | Fujita . | |
| 4,659,111 | 4/1987 | Credit . | |
| 4,763,930 | 8/1988 | Matney . | |
| 5,123,190 | 6/1992 | Erberber . | |

FOREIGN PATENT DOCUMENTS

| | | | |
|---|---|---|---|
| 380869 | 9/1932 | United Kingdom | 40/310 |

*Primary Examiner*—Brian K. Green
*Attorney, Agent, or Firm*—Isaf, Vaughan & Kerr

[57] ABSTRACT

A unique method and container for displaying a clear liquid windshield treatment comprises a clear bottle with a front and back label. The front label depicts a view from the inside of a car through the front windshield, which is cut-out to reveal the back label through the clear liquid product. The image of an oncoming car is printed on the inside of the back label so that the view from the front of the bottle simulates the view of an oncoming car through a windshield. When the bottle is shaken, tiny bubbles form in the liquid and migrate up interior surfaces of the bottle, thus simulating the dynamic water beading and sheeting action of the product when actually in use on a car's windshield.

7 Claims, 3 Drawing Sheets

TRANSPARENT LIQUID PRODUCT DISPLAY METHOD AND CONTAINER

FIELD OF THE INVENTION

This invention relates generally to product display methods and devices and, more particularly, to methods and associated containers for displaying and demonstrating the function of clear liquid products such as automotive windshield treatments.

BACKGROUND OF THE INVENTION

Effective and eye catching packaging for containing and displaying products on shelves of retail outlets has long been a sometimes illusive goal of product manufacturers. Virtually endless variations of product containers have been developed over the years. Most successful product containers are designed to attract the attention of passing shoppers and some are fabricated with clear or translucent portions through which the product in the container can be viewed directly. As a matter of fact, clear or translucent containers that reveal their products have been found to be particularly effective, especially for displaying liquid products such as soft drinks, food products, and liquid car care products.

One particular car care product, with which a preferred embodiment of the present invention is especially effective, is a relatively new product that, when applied to a windshield, causes rain to bead up and be blown upwardly off of the windshield. This product is known by various trademarks but each brand functions essentially the same. Specifically, when the solution is applied to the exterior surface of an automobile windshield, it forms an invisible film on the glass of the windshield. This film, in turn, acts to prevent water from spreading across the windshield glass. Instead, water, such as rain drops, forms individual beads on the filmed glass. As the car moves, the resulting wind tends to blow the beads of water up the windshield and onto the car's roof, where they do not present a viewing problem. The overall result is that the windshield remains relatively clear, even without the use of wipers. In fact, some brands of the product even advertise that they significantly reduce the need for windshield wipers.

In use, windshield treatments such as just described result in a unique sheeting action that creates the impression of hundreds or even thousands of beaded water droplets moving in unison upwardly toward the top of the windshield. This uniform upward movement of a multitude of water beads indeed represents the principal memorable attribute of water sheeting windshield treatments.

Accordingly, it is highly desirable to include an image of the beading and sheeting action of windshield treatments on the labels of bottles in which such treatments are displayed and sold. This has heretofore been accomplished through various graphic images of water beads on windshields printed on the bottles or printed on the labels affixed to the bottles. While this has been somewhat successful in illustrating the key memorable aspect of the product, it nevertheless fails to capture the full dynamic effect of the uniform movement of water beads up a car's windshield.

It would thus be highly desirable to display windshield treatments and similar products in containers that demonstrate on the shelf not only the static appearance of beaded water droplets on a windshield but also the dynamic movement of the droplets in unison up the windshield. Such a display would be uniquely attracting to passing shoppers and thus would lead inexorably to increased sales of the brand of product sold in the container. It is to the provision of just such a method and container that the present invention is primarily directed.

SUMMARY OF THE INVENTION

Briefly described, the present invention, in one preferred embodiment thereof, comprises a unique display bottle for containing and displaying windshield treatments on a store shelf. The bottle is clear or translucent so that the liquid solution therein, which typically and preferably is also clear, can be seen through the bottle. A front label is applied to the front of the bottle and a back label is applied to the back of the bottle. The front label is colorful and preferably bears the product trademark and other data and information about the product. The front panel of the back label typically bears instructions for use, obligatory warnings, and other details regarding the product, its contents, and its manufacturer.

At least a portion of the front label bears a graphic image depicting the view from the driver's seat and out the front windshield of an automobile. However, rather than a graphic image of the windshield itself, the label is cut out in the region of the windshield so that, when the bottle is viewed from its front, one sees through the front label and through the clear liquid product inside the bottle. Thus, the rear panel of the back label is clearly visible through the cut-out windshield portion of the front panel image.

A graphic image depicting the road ahead and an oncoming car with lit headlights is emblazoned on the rear panel of the bottle's back label. When viewing the bottle from its front, the road and oncoming car can be seen through the cut-out windshield, thus simulating the actual view through a real windshield. Further, the separation between the front and back labels tends to create a simulated 3-D effect wherein the oncoming car appears to move across the windshield's field of vision as one moves past the bottle.

The just described effect is unique and highly eye-catching in and of itself. However, a truly unique effect of this invention is realized when the bottle is lifted from the shelf, shaken vigorously, and replaced on the shelf. When this is done, the somewhat viscous nature of the liquid product causes formation of hundreds of tiny bubbles in the liquid. These bubbles, in turn, tend, because of surface tension, to migrate to the inner surfaces of the bottle, where they naturally rise to the top surface of the liquid. Bubbles moving up the side and rear surfaces of the bottle are generally un-noticed. However, bubbles moving up the interior surface of the front of the bottle, in conjunction with the labels, create an intriguing optical effect. Specifically, the bubbles simulate with a high degree of accuracy the appearance of beaded water droplets moving up a car's windshield on which the product has been used.

Thus, when viewing the bottle from its front, a shopper is presented with a simulated view of an oncoming car through his own car's windshield with what appears to be beaded water droplets being blown upwardly to the top of the windshield. The effect is uncanny and almost spellbinding. So much so, it has been found, that upon being exposed to the simulation, a shopper is more likely to purchase the brand of product contained in the bottle than other brands. Once purchased and used, then, the simulated sheeting action display becomes associated with the actual function of the product on a windshield. This association increases the likelihood that the user will continue to purchase the same product brand in the future.

Thus, it is seen that a unique method and bottle for displaying liquid windshield treatments and similar products is now provided. The bottle not only reveals the product for inspection, it provides an accurate simulation while sitting on a shelf of static and dynamic attributes of the product when actually in use. The end result is the creation in the minds of shoppers of an association that ultimately increases identification with and sales of the product. These and other objects, features, and advantages inherent in this invention will become more apparent upon review of the detailed description set forth below taken in conjunction with the accompanying drawings, which are briefly described as follows.

DETAILED DESCRIPTION OF THE PREFERRED EMBODIMENT

Figure 1:
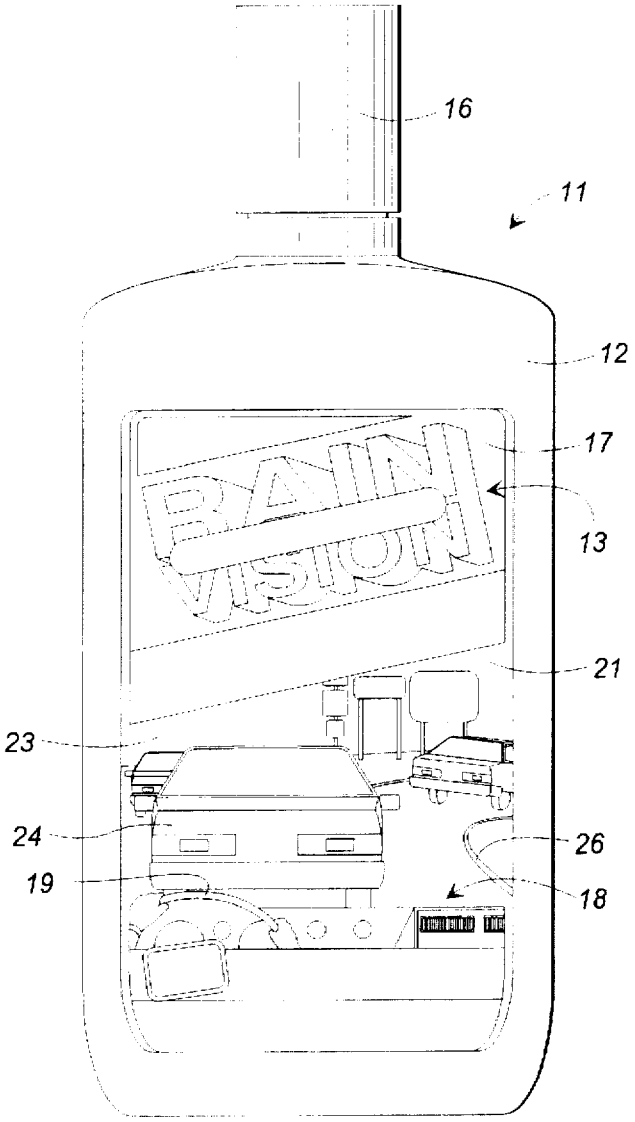
FIG. 1 is a front plan view of a bottle that embodies principals of the method and container of this invention in a preferred form.
Figure 3:
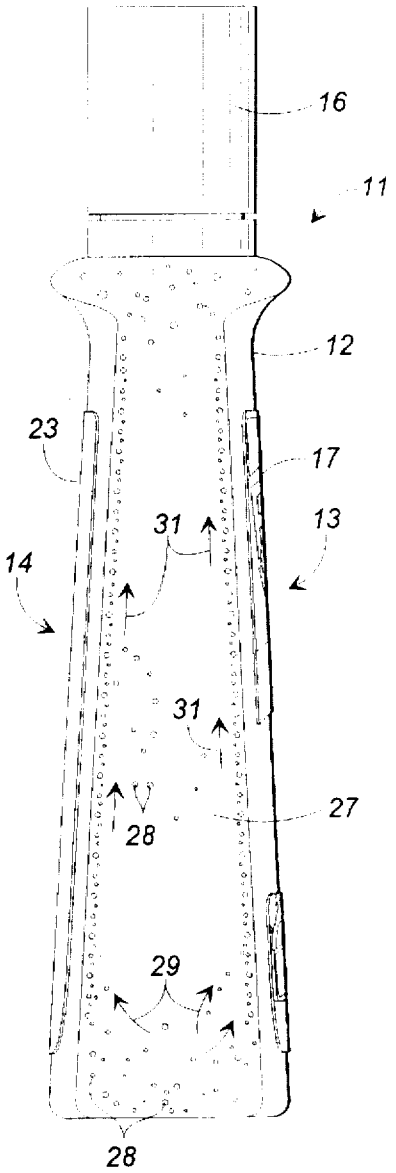
FIG. 3 is a side elevational view of the bottle of FIG. 1 after shaking and illustrating the action of bubbles in the liquid.

Referring now in more detail to the drawings, in which like numerals refer to like parts throughout the several views, FIG. 1 illustrates a product container that embodies principals of the present invention in a preferred form. The container 11 comprises a substantially clear bottle 12 having a front side 13 and a back side 14 (FIG. 3). In the preferred embodiment, the bottle 12 is formed of clear blow-molded plastic for economy. However, the bottle may well be formed of glass or other similar material. Further, it may not be entirely clear or transparent but might be transparent only at selected portions.

The bottle 12 is capped with a conventional top 16 through which product in the bottle can be expelled for use. In the preferred embodiment, the bottle 12 contains a substantially transparent liquid automotive windshield treatment. In use, the treatment is applied to the front windshield of a car where it forms a film causing water droplets to bead up on the windshield so that they can be blown up and to the top of the windshield by the breeze in a sheeting action. The purpose of the product is to improve vision in rainy conditions both with and without the use of windshield wipers.

Affixed to the front side 13 of the bottle 12 is a label 17. The label 17 is printed with the trademark of the product as well as other identifying information as shown. Further, in the central portion of the label is printed, a graphic representation depicting a view from inside an automobile through the front windshield thereof. The graphic representation includes a portion of the car's dashboard 18, a portion of its steering wheel 19, and a portion of the car's front windshield 21. As best illustrated in FIG. 2, the front label 17 is formed with a cut-out portion 22 in the region of the windshield 21 so that a passing shopper can see through the front label 17 as if looking through the windshield of the graphically illustrated automobile.

Figure 2:
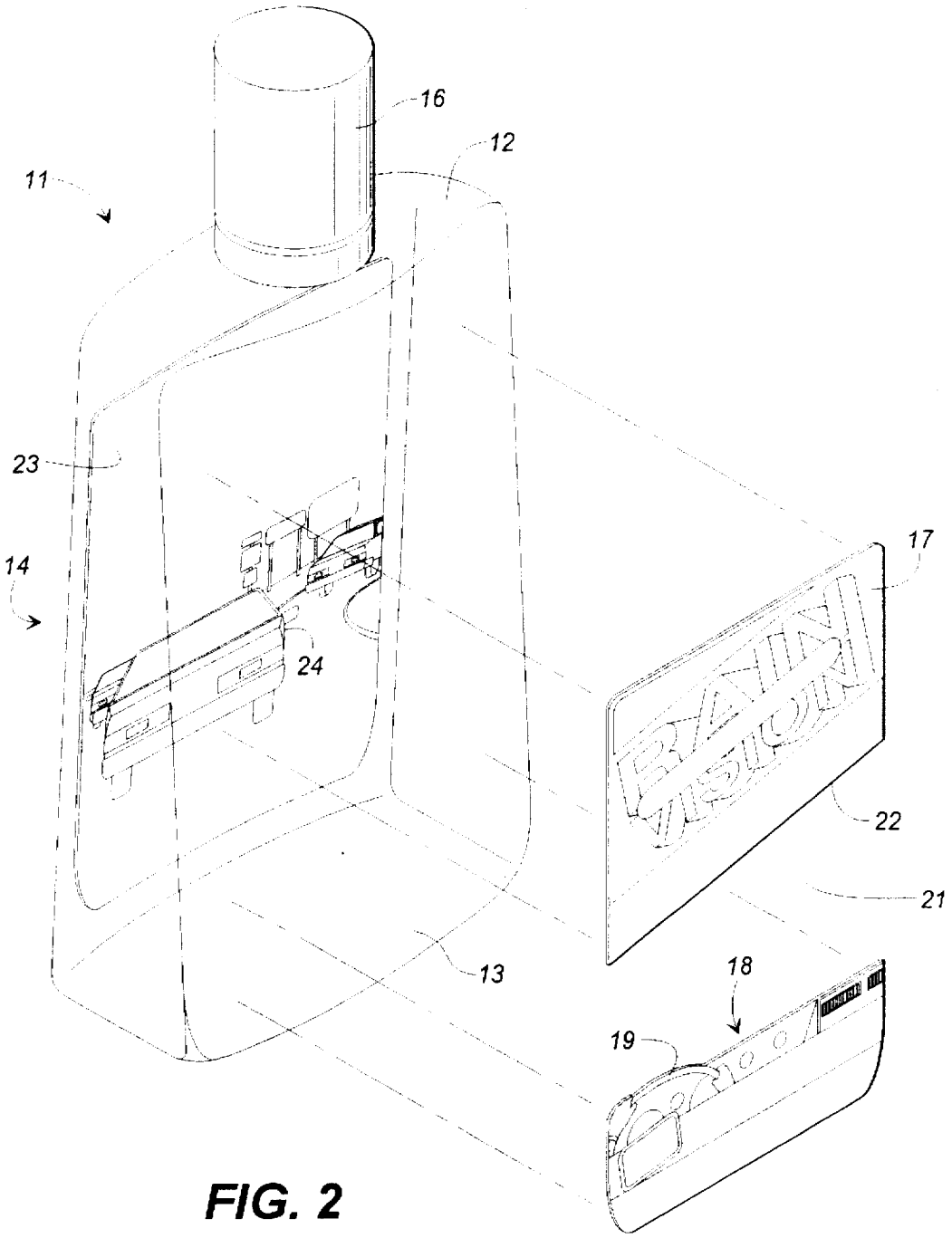
FIG. 2 is a perspective partially exploded view of the bottle of FIG. 1 depicting the cut-out front label and rear label thereof.

As best seen in FIG. 2, a back label 23 is affixed to the back side 14 of the bottle 12 in a location allowing it to be visible through the cut-out portion 22 in the front label. The back label 23 is printed with a graphic illustration 24 depicting an oncoming car with headlights blaring. Also illustrated on the back label is a portion of the road ahead 26.

With this arrangement, the container 11 itself simulates the view from inside an automobile through its front windshield and to an oncoming car ahead. Further, since the front and back labels are separated by the thickness of the bottle, a unique 3-D effect is created, whereby the oncoming car appears to move across the field of view of the windshield as a shopper passes the bottle on a shelf.

The windshield treatment product contained in the bottle 12 typically and preferably is a clear liquid having a somewhat viscous consistency. Thus, when viewing the container 11 from the front side, one sees through the cut-out portion of the front label, through the transparent product in the bottle, and to the graphic image printed on the back label 23. Looking through the clear liquid tends to enhance the unique and eye-catching 3-D effect created by the separation of the two labels in conjunction with the cut-out portion of the front label.

FIG. 2 illustrates the container 11 in perspective, partially exploded format to reveal clearly the relationship of the front and back labels to each other and to the bottle 12. Specifically, the back label 23 is seen to be affixed to the back side 14 of the bottle 12 in a position substantially aligned with and opposing the cut-out portion 22 forming the windshield 21 on the front label. Thus, the back label 23 as well as the graphics printed thereon, are clearly visible through the cut-out portion when viewing the bottle 12 from the front.

Figure 4:
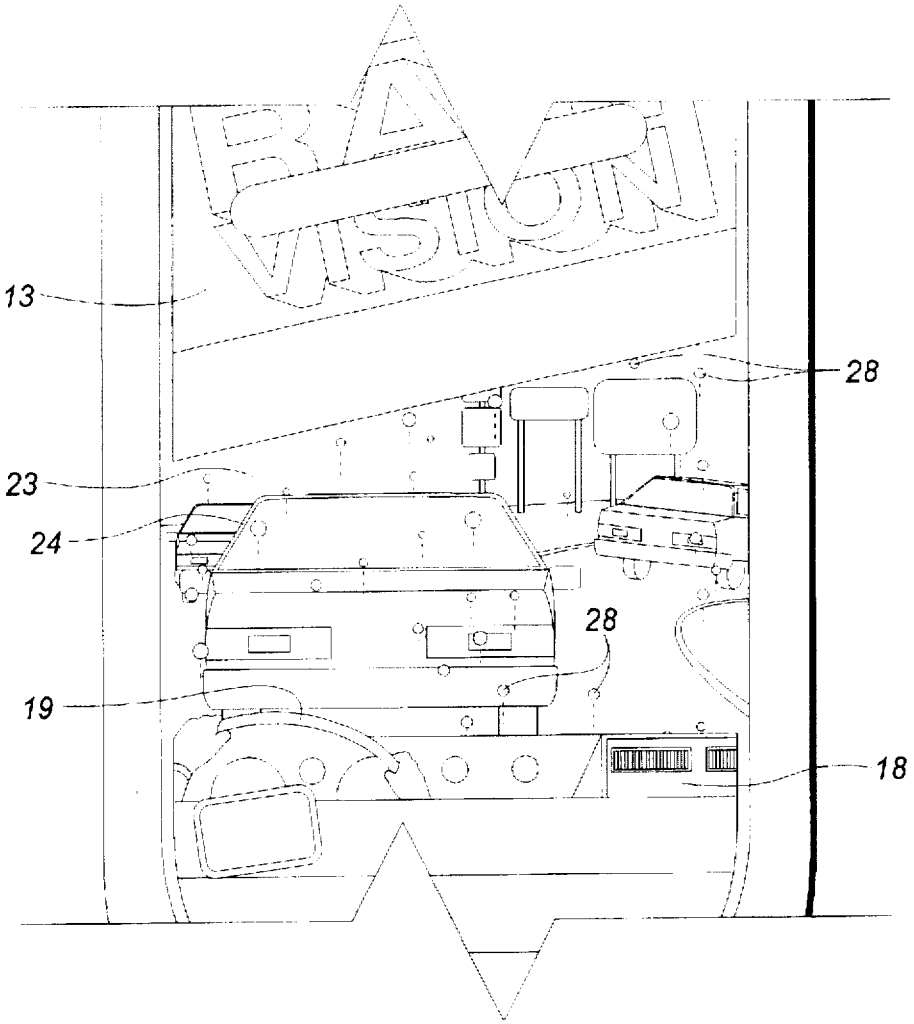
FIG. 4 is a partial front view of the bottle illustrating motion of bubbles after shaking to simulate sheeting action of the product when actually in use.

FIGS. 3 and 4 illustrate use of the just described container 11 to simulate in the bottle the beading and sheeting action of water droplets that fall on an actual windshield treated with the windshield treatment in the container. More specifically, the windshield treatment 27, which preferably is clear, is contained within the bottle 12. To initiate the simulation, the bottle 12 is simply removed from the shelf and shaken rapidly, causing a multitude of small bubbles 28 to form within the liquid treatment 27. The somewhat viscous nature of the liquid naturally creates small bubbles rather than large bubbles. These bubbles bear a relationship to the size of the graphically illustrated windshield 21 that is substantially similar to the relationship between beaded water droplets on an actual windshield and the actual windshield itself.

When the bottle has been thoroughly shaken, it is replaced back on the shelf or on another surface in an upright orientation as shown in FIG. 3. Due to surface tension, the small bubbles 28 that were formed during shaking naturally begin to migrate to the interior surfaces of the bottle 12 as illustrated by arrows 29. Once the bubbles have migrated to the interior surfaces of the bottle, they tend to cling somewhat to the surfaces but nevertheless move, under the influence of gravity, upwardly along the interior surfaces of the bottle as indicated by arrows 31. In doing so, many of the bubbles 28 move upwardly past the cut-out portion 22 of the front label 17, which simulates the front windshield of a car. Such movement is illustrated best in FIG. 4 wherein the bubbles 28 are shown followed by small trails indicating their movement past the windshield's field of view.

As the small bubbles 28 move upwardly past the cut-out windshield's field of view, their appearance, size, and speed of movement resemble with uncanny accuracy, the motion of beaded water droplets on an actual windshield that has been treated with the windshield treatment 27. Thus, the primary memorable attribute of the product 27 is actually simulated for a shopper while the bottle sits on the shelf in a store. Further, the rising bubbles simulating water droplets in conjunction with the 3-D effect of the oncoming car through the simulated windshield creates an eye-catching and very memorable impression that improves a shoppers identification with the product in the bottle. Accordingly, sales of the product are increased by the unique method and apparatus of the present invention.

The invention has been described herein in terms of preferred embodiments and methodologies. For example, use of the method and container of this invention has been illustrated with a clear liquid windshield treatment product. While it is believed that this is the most advantageous use of the invention, it is nevertheless clear that the same concept might well be applied to a myriad of other products where beading and sheeting action is desired to be simulated and demonstrated. Furthermore, the invention has been described in terms of an automotive product such that the simulated dashboard, oncoming car, and road ahead are appropriate graphic illustrations. However, virtually any graphic illustration appropriate to the use of the particular product contained in the bottle might well be printed on the labels. Various other additions, deletions, and modifications might also be made to the preferred and illustrated embodiment without departing from the spirit and scope of the invention as set forth in the claims.

I claim:

1. For use with a substantially transparent liquid windshield treatment that, when applied to an automotive windshield, causes water to bead on the windshield so that it can be blown up and off of the windshield by the wind, a method of containing and displaying the windshield treatment and of demonstrating through simulation the functioning of the windshield treatment on an actual windshield, said method comprising the steps of:

(a) providing a bottle having interior surfaces and a front side bearing a front label printed with a graphic representation of the view from inside an automobile through the windshield thereof, the front label having a cut-out portion in the windshield of the graphic representation to reveal product in the bottle through the cut-out portion;

(b) filling the bottle with transparent liquid windshield treatment;

(c) shaking the bottle rapidly to cause small bubbles to form in the liquid windshield treatment, the bubbles migrating to the interior surfaces of the bottle;

(d) placing the shaken bottle in an upright orientation to cause the bubbles to rise up the interior surfaces of the bottle and past the cut-out portion of the front label to simulate the rising of beaded water droplets on an actual windshield to which the treatment has been applied; and (e) observing the bottle from the front side thereof for a simulated demonstration of the functioning of the windshield treatment on an actual windshield.

2. The method of claim 1 and wherein the bottle further includes a back label positioned to be visible through the cut-out portion of the front label with the back label being printed with a graphic representation adapted to enhance the simulated demonstration of the product, and wherein step (d) further comprises observing the back label through the cut-out portion of the front label as the bubbles rise past the cut-out portion.

3. The method of claim 2 and wherein the graphic representation printed on the back label depicts an oncoming car to simulate a view of an oncoming vehicle through the windshield of the graphic representation on the front label.

4.the method of claim 3 and wherein the graphic representation printed on the label further depicts the road ahead to enchance the simulation further.

5. A method of simulating the beading and sheeting action on a windshield of a liquid windshield treatment product, said method comprising the steps of placing the product in a substantially clear bottle having interior surfaces, applying a front label to the bottle with the front label being formed with a cut-out portion revealing product within the bottle, applying a back label to the bottle in a location to be viewed through the cut-out portion of the front label with the back label having a graphic indicia printed thereon, shaking the bottle to cause small bubbles to form in the liquid product and migrate to the interior surfaces of the bottle, and placing the shaken bottle in an upright orientation to cause the bubbles to rise up the interior surfaces of the bottle and past the cut-out portion formed in the front label thereby simulating through the cut-out portion the beading and sheeting action of the product when applied to an actual windshield.

6. The method of claim 5 and wherein the front label is printed with a graphic representation of a view from the inside of a car through the windshield thereof and wherein the cut-out portion of the front label is formed in the windshield of the graphic representation.

7. The method of claim 6 and wherein the graphic indicia printed on the back label includes an image of an oncoming car to enhance the reality of the simulation.

* * * * *